United States Patent [19]

Frantzen

[11] 4,397,708

[45] Aug. 9, 1983

[54] ETCHING AND ETCHANT REMOVAL APPARATUS

[75] Inventor: John J. Frantzen, San Jose, Calif.

[73] Assignee: Koltron Corporation, Sunnyvale, Calif.

[21] Appl. No.: 190,875

[22] Filed: Sep. 25, 1980

[51] Int. Cl.[3] ..... C23F 1/02

[52] U.S. Cl. ..... 156/345; 134/49; 134/57 R; 156/640; 156/642

[58] Field of Search ..... 156/345, 642, 640, 654, 156/659.1; 134/46, 49, 57 R, 110

[56] References Cited

U.S. PATENT DOCUMENTS

| | | | |
|---|---|---|---|
| 3,282,273 | 11/1966 | Johnston et al. | 156/345 X |
| 3,935,041 | 1/1976 | Geffredo et al. | 156/345 X |
| 4,333,485 | 6/1982 | Karlsson et al. | 134/111 X |

OTHER PUBLICATIONS

Lecatsas and Merkel, *Laminar Flow Coating,* Western Electric Technical Digest No. 29, Jan. 1973, pp. 39–40.

*Primary Examiner*—William A. Powell
*Assistant Examiner*—Thomas Bokan
*Attorney, Agent, or Firm*—Thomas E. Schatzel

[57] ABSTRACT

Etching method and etching and etchant removal apparatus. A specific embodiment includes two sets of fan spray nozzles located adjacent to the etching chamber and positioned to direct a spray at the work piece as the work piece exits the etching chamber. A sensor is also located adjacent to the etching chamber for turning the nozzles on when the work piece is present. Hydrometer means for determining the specific gravity of the etchant solution controls one set of nozzles whereby the nozzles are turned on to decrease the density of the etchant and turned off to increase the density of the etchant.

5 Claims, 3 Drawing Figures

ETCHING AND ETCHANT REMOVAL APPARATUS

BACKGROUND OF THE INVENTION

1. Field of the Invention

The invention relates generally to chemical material removal processes and more particularly to removal of excess etchant from the work piece in a chemical material removal process.

2. Description of the Prior Art

Chemical material removal processes, which use chemicals as "cutting tools," involve the use of acid and alkaline solutions to etch away unwanted material, leaving the final desired pattern or part. An acid or alkaline resistant material (known as a maskant or a resist) is applied to certain portions of the work piece, and subsequent application of an etchant removes the desired material, leaving unaffected the material covered by the resist. The etchant is applied to the work piece in an etching chamber by immersion, splash, or spray. Following etching, the work piece is generally washed to remove excess etchant.

In the prior art, disposal of the excess etchant has been costly, especially where a high density etchant is used, and sometimes has precluded the use of an etchant that is otherwise chemically and metallurgically acceptable. The excess etchant is neutralized to a pH of approximately nine and then pumped to a settling tank. Generally the etchant has a higher density than water and will settle to the bottom of the tank along with any other impurities. The sludge from the bottom of the settling tank is pumped out and transported to a waste disposal area. The solution which flows from the top of the tank contains fewer impurities and is therefore sent directly to the sewer system. The particle content of waste introduced into sewer lines must meet strict standards. Where a plant produces large quantities of waste etchant, compliance with these standards is difficult and expensive.

Chemcut Corporation, a manufacturer of etching systems, uses a blower installed adjacent to the etching chamber and below the work piece travel path for blowing air directed at the work piece to remove some excess etchant. However, this system has proved to be inadequate for reducing waste etchant. The blower used by Chemcut has only been effective in removing approximately ten percent of the excess etchant. A further disadvantage is that the blower always remains on, whether or not a work piece is present.

SUMMARY OF THE PRESENT INVENTION

It is an object to provide an improved apparatus for removing excess etchant from a work piece.

It is a further objective to reduce the cost for disposal of waste etchant.

It is a further objective to reduce the volume of water required to remove excess etchant from a work piece so that the excess etchant may be recycled for further etching.

It is a further objective to automatically control the density of the etchant in the etching chamber with the apparatus for removal of excess etchant.

Briefly, in a preferred embodiment the present invention includes two sets of fan spray nozzles located adjacent to the etching chamber and positioned to direct a spray at the work piece as the work piece exits the etching chamber. A sensor is also located adjacent to the etching chamber for turning the nozzles on when the work piece is present. Hydrometer means for determining the specific gravity of the etchant solution controls one set of nozzles whereby the nozzles are turned on to decrease the density of the etchant and turned off to increase the density of the etchant.

An advantage of the process for removing excess etchant of the present invention is that the amount of excess etchant removed is increased.

An advantage of the apparatus for removing excess etchant is that the amount of excess etchant removed is increased.

A further advantage is that the cost for disposal of waste etchants is reduced.

A further advantage is that the volume of water required to remove excess etchant is reduced so that excess etchant may be recycled for further etching.

A further advantage is that the density of the etchant in the etching chamber may be controlled by the apparatus for removal of excess etchant.

These and other objects and advantages of the present invention will no doubt become obvious to those of ordinary skill in the art after having read the following detailed description of the preferred embodiment which is illustrated in the various drawing figures.

IN THE DRAWING

DETAILED DESCRIPTION OF THE PREFERRED EMBODIMENT

Figure 1:
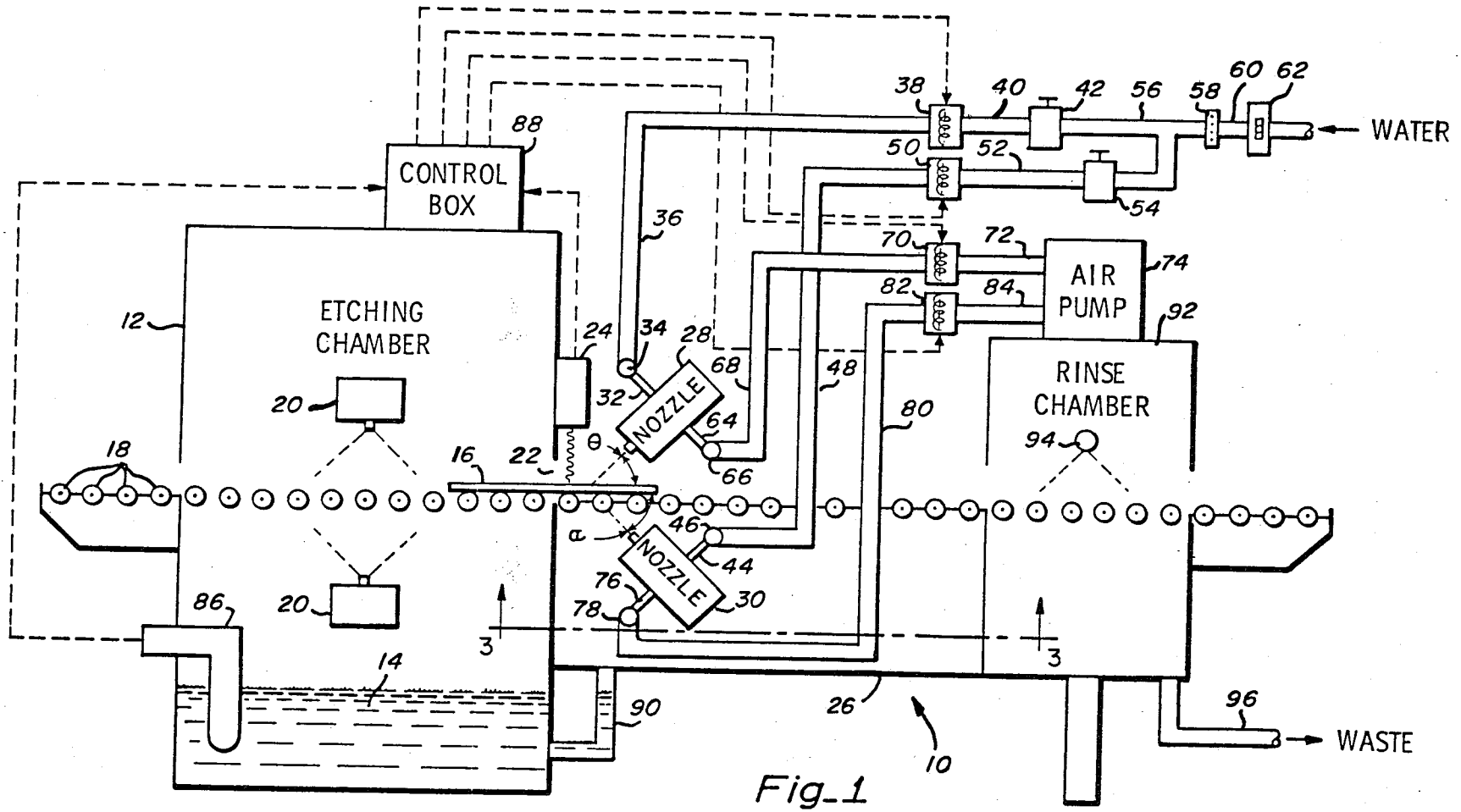
FIG. 1 is a side elevational view of an etching apparatus including the etchant removal apparatus of the present invention.

FIG. 1 illustrates an etching apparatus referred to by the general reference numeral 10 and including the present invention. The etching apparatus 10 includes an etching chamber 12 which contains a volume of an etchant solution 14. A work piece 16 which is to be chemically milled, is transported through the etching chamber 12 by a conveyor 18. The etchant solution 14 is applied to the work piece 16 by spray nozzles 20 positioned within the chamber 12.

The work piece 16, after being subjected to the etchant solution, exits the etching chamber 12 through an exit portal 22. Located adjacent to the etching chamber 12 and above the exit portal 22 is a sensor 24. Also located adjacent to the etching chamber 12 and below the conveyor 18 is a collecting tank 26 to collect liquid solution about the exterior of the portal 22. Located adjacent to the etching chamber 12 about the portal 22 is a set of nozzles 28 located above the conveyor 18 and the work piece travel path. The nozzles 28 produce a fan spray directed such that the plane of the spray produced by the nozzles 28 intersects the plane of the work piece travel path at an acute angle $\theta$, as illustrated in FIG. 1. Also located adjacent to the exterior of the etching chamber 12 near the exit portal 22 below the conveyor 18 and below the work piece travel path is a set of nozzles 30. The nozzles 30 also produce a fan spray directed such that the plane of the spray intersects the plane of the work piece travel path at an acute angle, as illustrated in FIG. 1.

Coupled to each of the nozzles 28 is a pipe 32 which joins the nozzles 28 to a header 34. The header 34 is connected to a pipe 36 which is connected to a solenoid valve 38. The solenoid valve 38 is connected through a pipe 40 to a flow valve 42.

Each of the nozzles 30 is connected to a pipe 44 which is connected to a header 46. The header 46 is connected to a pipe 48 which is connected to a solenoid valve 50. The solenoid valve 50 is connected to a pipe 52 which is connected to a flow valve 54. The flow valves 42 and 54 are connected to a pipe 56 which is connected to a filter 58. The filter 58 is connected to a pipe 60 which is connected to a flow meter 62. The flow meter 62 is connected to a liquid supply source illustrated as water.

Each of the nozzles 28 is connected to a pipe 64 which is connected to a header 66. The header 66 is connected to a pipe 68 which is connected to a solenoid valve 70. The solenoid valve 70 is connected through a pipe 72 to a gas source 74 illustrated as an air pump.

Each of the nozzles 30 is connected to a pipe 76 which is connected to a header 78. The header 78 is connected to a pipe 80 which is connected to a solenoid valve 82. The solenoid valve 82 is connected through a pipe 84 to the air pump 74.

The etching chamber 12 includes a hydrometer 86 for measuring the specific gravity of the etchant solution 14. The hydrometer 86 is electrically connected to a control box 88. The sensor 24 is also electrically connected to the control box 88. Electrical outputs from the control box 88 are fed to the solenoid valves 38, 50, 70 and 82.

A recycling pipe 90 is connected at the base of the tank 26 and feeds to the etching chamber 12. The base of the tank 26 is preferably above the level of the etchant solution 14 in the etching chamber 12. The recycling pipe 90 is also preferably connected to the etching chamber at a point below the base of the tank 26.

Adjacent to the tank 26 is a rinse chamber 92 for receiving the work piece 16 after the work piece passes the nozzles 28 and 30. The rinse chamber 92 includes a sprayer 94. The conveyor 18 transports the work piece 16 through the etching chamber 12, over the tank 26 and through the rinse chamber 92. Connected at the base of the rinse chamber 92 is a drain pipe 96 for the waste solution.

Figure 2:
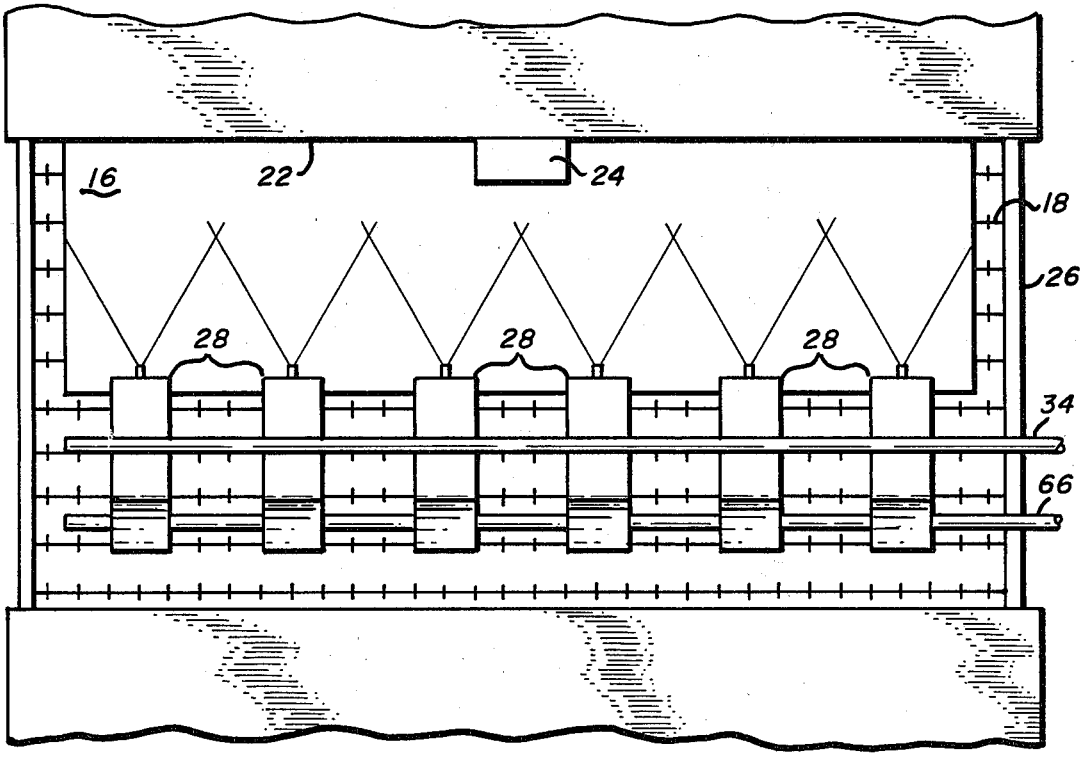
FIG. 2 is a top view of the etchant removal apparatus illustrated in FIG. 2.
Figure 3:
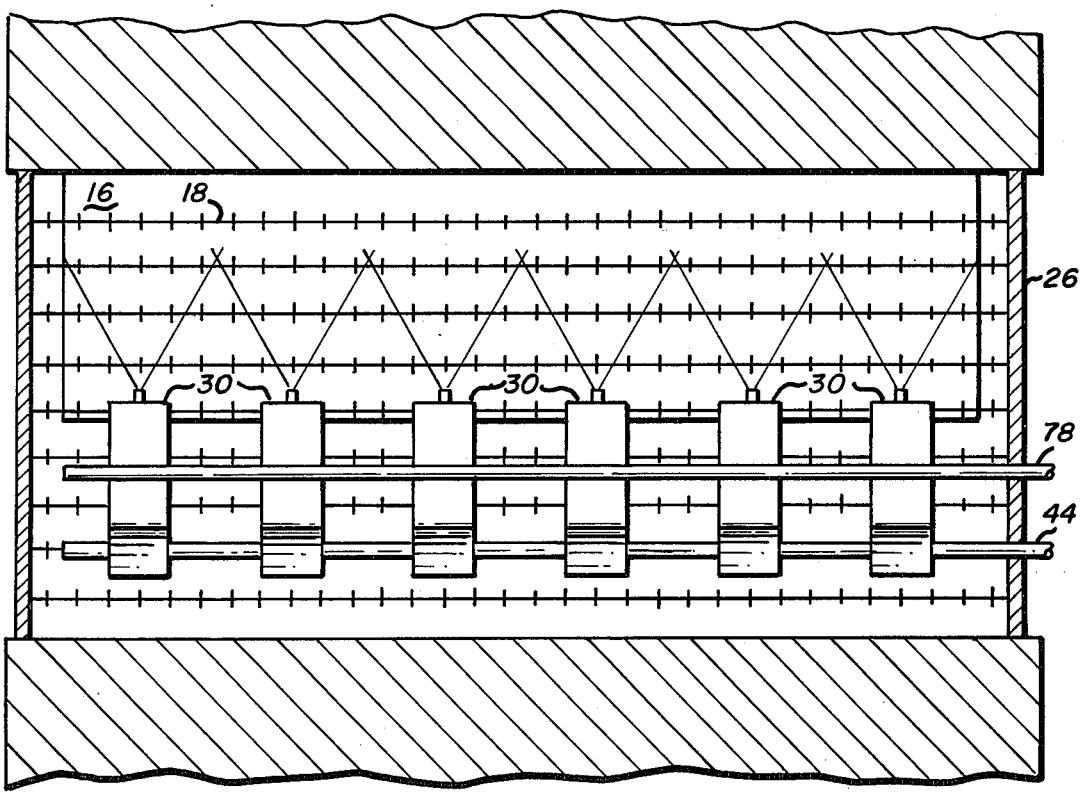
FIG. 3 is a cross-sectional bottom view taken along the line 3—3 of FIG. 1 of the etchant removal apparatus viewed from a location below the work piece travel path.

FIG. 2 is a top view above the tank 26 and illustrates the fan spray pattern from the nozzles 28 impinging upon the work piece 16 as the work piece exits through the portal 22 on the conveyor 18. FIG. 3 is a cross-sectional view from within the tank 26 taken along the line 3—3 of FIG. 1 and illustrates the fan spray pattern from the nozzles 30 impinging upon the work piece 16 as the work piece exits through the portal 22 on the conveyor 18.

The operation of the etching apparatus 10 is believed to be as follows. The work piece 16 is placed on the conveyor 18 at an entrance of the etching chamber 12. The work piece 16 is then transported through the etching chamber 12 and past the sprayers 20. The sprayers 20 subject the work piece 16 to the etchant solution 14. Those portions of the work piece 16 which have not been treated with a mask will be etched away. The etched work piece 16 will then exit the etching chamber 12 through the exit portal 22.

As the work piece 16 passes under the sensor 24, the sensor 24 senses the presence of the piece 16 and sends a sense signal to the control box 88 indicating the presence of the work piece 16. The control box 88, in response to the sense signal then sends signals to the solenoid valves 38 and 70, causing the valves 38 and 70 to open. When the solenoid valve 38 is open, water will flow to the nozzles 28. Likewise, when the solenoid valve 70 is open, compressed air will also flow to the nozzles 28. The air and water supplied to the nozzles 28 are mixed in a chamber within the nozzles 28. The nozzles 28 will thereby produce a fan spray consisting of an air-water mixture. To effectively remove excess etchant the air pressure should be approximately 75–100 pounds per square inch. The mixture of pressurized air and water produces a spray of water particles with sufficient velocity that excess etchant may be removed with a greatly reduced volume of water. In fact, when only the nozzles 28 are in use, the specific gravity of the etchant solution 14 is not reduced appreciatively.

The hydrometer 86 senses the specific gravity of the solution 14 and produces an output when the specific gravity of the etchant solution 14 rises above a specified level. When the sensor 24 detects the work piece 16 and the hydrometer 86 outputs a signal, indicating the specific gravity of the etchant solution 14 is above the specified level, the control box 88 responds and provides control signals to the solenoid valves 50 and 82, causing them to open. When the solenoid valves 50 and 82 open, water and air will flow to the nozzles 30. The water and air received by the nozzles 30 will be mixed in a chamber within the nozzles 30 and thereby produce a fan spray mixture of air and water. Again the air pressure should preferably be approximately 75–100 psi. The spray produced by the nozzles 30 will impinge upon the bottom side of the work piece 16, thereby removing additional etchant solution carried out from the etching chamber 12 by the work piece 16. After the work piece 16 has moved pass the sensor 24 the solenoid valves 38, 50, 70 and 82 will again be closed.

The flow valves 42 and 54 may be manually adjusted to control the amount of water received by the nozzles 28 and 30 respectively. The filter 58 is installed to prevent particles carried in the water from clogging the nozzles 28 and 30. The flow meter 62 is used to measure the amount of water flowing to the nozzles 28 and 30.

The excess etchant removed from the work piece 16 is collected in the tank 26 and recycled to the etching chamber 12 through the recycling pipe 90. When the solenoid valves 50 and 82 have been opened because the specific gravity of the etching solution 14 is too high, a greater amount of water will be recycled to the etching chamber 12, thereby decreasing the specific gravity of the etchant solution 14. The bottom side of the work piece 16 will generally carry less excess etchant than the top side. Thus, when the nozzles 30 are in use the amount of water relative to excess etchant will be sufficient to lower the specific gravity of the etchant solution 14. The specific gravity of the etchant solution 14 will generally be higher than the specific gravity of water, thus adding water to the etchant solution 14 will lower its specific gravity.

The work piece 16 will next be transported by the conveyor 18 to the rinse chamber 92. As the work piece 16 passes through the rinse chamber 92, the sprayer 94 will spray water onto the work piece 16. Any etchant not removed by nozzles 28 and 30 will be removed from the work piece 16 in the rinse chamber 92. The water and waste etchant will be drained from the rinse chamber 92 through the drain pipe 96.

The etching apparatus 10 of the present invention reduces the amount of waste etchant sent to the sewer system. The nozzles 28 and 30 remove much of the excess etchant solution 14 carried out of the etching chamber 12 by the work piece 16 without applying large volumes of water to the work piece 16. Thus the etching solution 14 collected in the tank 26 may be recycled to the etching chamber 12. Because the amount of etchant sent to the sewer system is reduced, the cost of neutralizing the etchant is reduced. Finally, the etching apparatus 10 allows the specific gravity of the etchant solution 14 to be automatically controlled.

Although the present invention has been described in terms of the presently preferred embodiment, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An etching and etchant removal apparatus for removing liquid etchant from a work piece comprising:

an etching chamber including means for transporting a work piece therethrough along a work piece travel path and subjecting said work piece to an etchant solution within the chamber;

first nozzle means including a mixing chamber and a spray spout located adjacent to the etching chamber near an exit portal of the etching chamber and adjacent to said work piece travel path, the first nozzle means being positioned with said spray spout oriented to direct a spray along a pattern intersecting said travel path at an acute angle;

means for joining a liquid solution source to said mixing chamber of the first nozzle means;

means for joining a gas source to said mixing chamber of the first nozzle means simultaneously with said liquid solution to provide a liquid spray from said spray spout;

a collecting tank located near the first nozzle means and adjacent to the etching chamber near said exit portal for receiving etchant solution removed from said work piece;

recycling means connected to the collecting tank and to the etching chamber for returning etchant removed from said work piece to the etching chamber;

first control valve means connected to the first nozzle means, the first control valve means including a movable element for controling passage of liquid to said mixing chamber of the first and second nozzle means;

second control valve means connected to the first nozzle means, the second control valve means including a movable element for controlling passage of gas to said mixing chamber of the first nozzle means;

electrical control means connected to said movable elements of said first and second valve means for controlling the movement of said movable elements responsive to sensing signals; and sensing means located adjacent to the etching chamber near said exit portal for sensing the presence of said work piece as said work piece exits the etching chamber, the sensing means being connected to the electrical control means for providing a first electrical sensing signal to the control means when the presence of said work piece is sensed whereby said movable elements of the first and second control valve means are positioned to permit passage of said liquid and gas to said mixing chamber of the first nozzle means.

2. The etching and etchant removal apparatus of claim 1, further comprising:

second nozzle means including a mixing chamber and spray spout located adjacent to the etching chamber near said exit portal and on the opposite side of the work piece travel path from the first nozzle means, the second nozzle means being positioned with said spray spout oriented to direct a spray along a pattern intersecting said travel path at an acute angle;

means for joining a liquid solution source to said mixing chamber of the second nozzle means;

means for joining a gas source to said mixing chamber of the second nozzle means simultaneously with said liquid solution to provide a liquid spray from said spray spout of the second nozzle means;

third control valve means connected to the second nozzle means, the third control valve means including a movable element for controlling passage of liquid to said mixing chamber of the second nozzle means;

fourth control valve means connected to the second nozzle means, the fourth control valve means including a movable element for controlling passage of gas to said mixing chamber of the second nozzle means;

hydrometer means for determining the specific gravity of said etchant solution, the hydrometer means providing a second sensing signal to the electrical control means when the specific gravity of the etchant solution rises above a specified level; and the electrical control means being connected to said movable elements of said third and fourth control valve means for controlling the movement of said movable elements of said first, second, third and fourth control valve means responsive to said first and second sensing signals.

3. The etching and etchant removal apparatus of claim 1 further comprising:

filter means connected between said liquid solution source and the first nozzle means.

4. The etching and etchant removal apparatus of claim 2, further comprising:

filter means connected between said liquid solution source and both the first nozzle means and second nozzle means.

5. The etching and etchant removal apparatus of claim 2, further comprising:

a rinse chamber means positioned along said work piece travel path for receiving said work piece after said work piece passes the nozzle means, the rinse chamber means including spray means to spray liquid onto said work piece.

* * * * *